United States Patent [19]

Romuno

[11] Patent Number: 5,039,128

[45] Date of Patent: Aug. 13, 1991

[54] SKI LIGHT

[76] Inventor: Nicholas J. Romuno, 43 Armon Dr., Bethpage, N.Y. 11714

[21] Appl. No.: 555,108

[22] Filed: Jul. 20, 1990

[51] Int. Cl.[5] ..... A63C 11/00

[52] U.S. Cl. ..... 280/816; 362/253

[58] Field of Search ..... 362/190, 191, 200, 253, 362/347; 441/65, 74, 129; 280/809, 816

[56] References Cited

U.S. PATENT DOCUMENTS

| | | | |
|---|---|---|---|
| 1,363,698 | 12/1920 | Wacker | 362/200 |
| 4,083,572 | 4/1978 | May, Jr. | 362/191 X |
| 4,414,611 | 11/1983 | Seltzer et al. | 362/200 X |
| 4,546,650 | 10/1985 | Cameron | 280/809 X |
| 4,623,957 | 11/1986 | Moore et al. | 362/200 |
| 4,754,376 | 6/1988 | Winslow | 362/191 X |
| 4,837,494 | 6/1989 | Maier | 280/809 X |
| 4,881,155 | 11/1989 | Gahagan | 362/191 |

*Primary Examiner*—David M. Mitchell
*Assistant Examiner*—Michael Mar
*Attorney, Agent, or Firm*—Ladas & Parry

[57] ABSTRACT

A ski light is provided and consists of a housing mounted to a ski. The housing has a front transparent enclosure with a curved reflector therein and a lamp mounted in the center of the reflector. An electrical circuit within the housing is for illuminating the lamp. This helps a skier find the ski when it disengages from the foot of the skier, to warn other skiers of the skiers presence and to help find the skier if disabled and in need of assistance, especially during the nighttime hours.

12 Claims, 1 Drawing Sheet

10
12
14
16
18
20
22
24
26
28
30
32
34
36
38
40
42
44
46

SKI LIGHT

BACKGROUND OF THE INVENTION

1. Field of the Invention

The instant invention relates generally to ski accessories and more specifically it relates to a ski light.

2. Description of the Prior Art

Numerous ski accessories have been provided in prior art that are adapted to help assist a person when he person is skiing. While these units may be suitable for the particular purpose to which they address, they would not be as suitable for the purposes of the present invention as heretofore described.

SUMMARY OF THE INVENTION

A primary object of the present invention is to provide a ski light that will overcome the shortcomings of the prior art devices.

Another object is to provide a ski light which is attached to a ski to help a skier find a lost ski when the ski disengages from the foot of the skier when skiing.

An additional object is to provide a ski light which is attached to a ski to warn other skiers of a skiers presence and to help find a disabled skier in need of assistance.

A further object is to provide a ski light that is simple and easy to use.

A still further object is to provide a ski light that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3, 4, 5, 6:
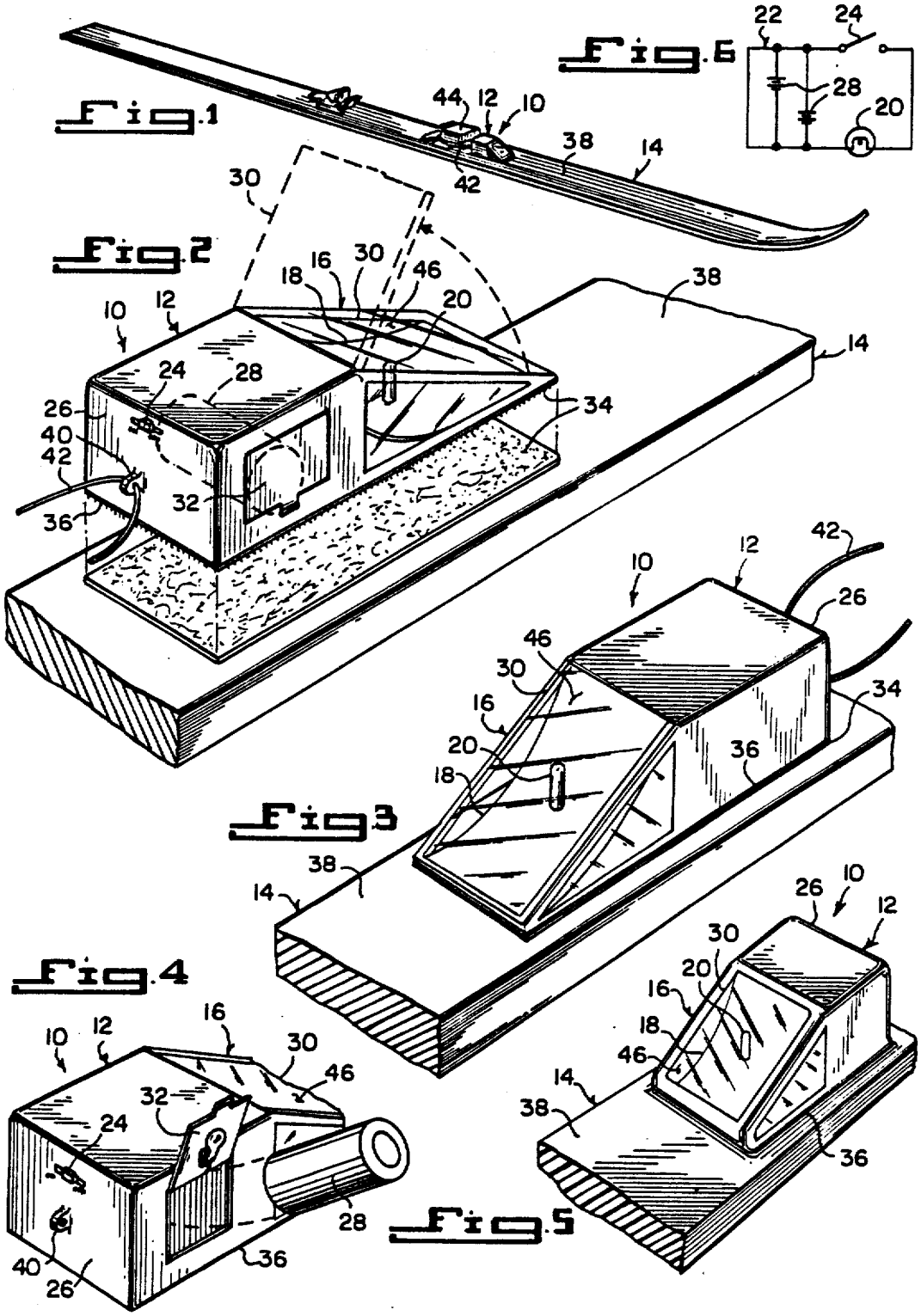
FIG. 1 is a front perspective view of a ski with the invention removably attached thereto.
FIG. 2 is an enlarged rear perspective view of the ski light being removed from the ski.
FIG. 3 is an enlarged front perspective view of the ski light reattached to the ski.
FIG. 4 is an enlarged rear perspective view of the ski light removed from the ski with parts broken away showing the battery removed therefrom.
FIG. 5 is an enlarged front perspective view of a modification showing the ski light permanently molded to the ski.
FIG. 6 is a schematic diagram of the electrical circuit of the invention.

Turning now descriptively to the drawings, in which similar reference characters denote similar elements throughout the several views, the Figures illustrate a ski light 10 consisting of a housing 12 mounted to a ski 14. The housing 12 has a front transparent triangular segment 16. A curved reflector 18 is mounted in the front transparent enclosure 16 of the housing 12 with a lamp 20 mounted in the center of the reflector 18. An electrical circuit 22 is provided for illuminating the lamp 20 within the housing 12 and has an on-off switch 24 on the back 26 of the housing 12 and at least one battery 28 connected to the lamp 20.

The ski light 10 helps a skier find the ski 14 when it disengages from the foot of the ski, warns other skiers of the skier's presence and helps find the skier if disabled and in need of assistance, especially during the nighttime hours.

The front transparent enclosure 16 of the housing 12 further includes a top transparent access lid 30 so that removal and replacement of the lamp 20 can be accomplished when needed. The housing 12 has a side access door 32 so that removal and replacement of the battery 28 can be accomplished when needed.

As best seen in FIG. 2, a hook and loop pile fastener 34, known as the trademark VELCRO is disposed between the bottom 36 of the housing 12 and the top 38 of the ski so that the housing 12 can be removably attached to a standard ski 14. An eyelet 40 is formed on the back 26 of the housing 12 below the on-off switch 24. A lanyard 42 is looped through the eyelet 40 and is engagable with a toe binding structure 44 on the ski 14 so that if the housing 12 is disengaged from the ski 14 by separation of the hook and loop pile fastener 34 the lanyard 42 will retain the housing 12 of the ski light 10 thereby so that the lamp 20 can still be visually seen.

The transparent access lid 30 can be a magnifying lens 46 to increase the visual illumination of the lamp 20. As shown in FIG. 5, the bottom 36 of housing 12 can be permanently molded to the top 38 of the ski 14 so that the housing 12 will never disengage from the ski 14.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A self-contained ski light for use with skis, comprising:

(a) a housing having an upper portion and an underside portion, said housing being removably mounted at its underside portion to the top surface of the ski away from the tip of the ski, said housing having a transparent front wedge shaped segment with a transparent top which slopes downward and forwardly from a forward edge of the upper portion to a forward edge of the underside portion and transparent sides which extend between said transparent top and said underside portion, said sloping front segment preventing snow and ice from building up in the front thereof;

(b) a curved reflector mounted inside said housing behind said sloping transparent front segment of said housing, said reflector having forward and rearward edges located adjacent respective forward and rearward edges of said transparent top;

(c) a lamp mounted in front of said curved reflector between said curved reflector and said front transparent segment; and (d) battery means including an electrical circuit connected to said lamp for illuminating said lamp, whereby when said lamp is illuminated, light projects upwardly, sideways and forwardly of said sloping transparent front segment.

2. A self contained ski light as claimed in claim 1, wherein said electrical circuit includes an on/off switch.

3 A self contained ski light as claimed in claim 1, wherein said sloping transparent top comprises a transparent access lid which allows access to said lamp.

4. A self contained ski light as claimed in claim 3, wherein said transparent access lid comprises a magnifying lens to increase the visual illumination of said lamp.

5. A self contained ski light as claimed in claim 1, wherein said ski light is removably mounted to the top surface of the ski away from the tip of the ski by a hook and loop fastener means, thereby permitting said ski light to be removably attached to standard skis.

6. A self contained ski light as claimed in claim 5, wherein said housing further comprises an access door for access to said at least one battery.

7. A self contained ski light as claimed in claim 5, further comprising an eyelet means formed on said housing and a lanyard means, said lanyard means being looped through said eyelet means and engagable with ski bindings on the ski, so that if said hook and loop fastener means disengage, said lanyard means will prevent said ski light from being separated from said ski, and thereby aid in the recovery of a lost ski.

8. A ski light comprising:

(a) a housing having an upper portion and a lower portion, said housing permanently molded to the top surface of a ski away from the tip of the ski, said housing including a transparent front wedge shaped segment with a transparent top which slopes downwardly and forwardly from a forward edge of the upper portion and transparent sides which extend between said transparent top and said lower portion, said sloping front segment preventing snow and ice from building up in the front thereof;

(b) a curved reflector mounted behind said transparent front segment of said housing, said reflector having forward and rearward edges located adjacent respective forward and rearward edges of said transparent top;

(c) a lamp mounted in front of said curved reflector between said curved reflector and said transparent front segment; and (d) battery means including an electrical circuit connected to said lamp for illuminating said lamp, whereby when said lamp is illuminated, light projects upwardly, sideways and forwardly of said sloping, transparent front segment.

9. A ski light as claimed in claim 8, wherein said electrical circuit includes an on/off switch.

10. A ski light as claimed in claim 8, wherein said transparent top comprises a transparent access lid which allows access to said lamp.

11. A ski light as claimed in claim 10, wherein said access lid comprises a magnifying lens to increase the visual illumination of said lamp.

12. A ski light as claimed in claim 8, wherein said housing further comprises an access door for access to said at least one battery.

* * * * *